US007987978B1

(12) United States Patent
Lam

(10) Patent No.: US 7,987,978 B1
(45) Date of Patent: Aug. 2, 2011

(54) REED CASE

(76) Inventor: Kuen W Lam, Randolph, MA (US)

( * ) Notice: Subject to any disclaimer, the term of this patent is extended or adjusted under 35 U.S.C. 154(b) by 137 days.

(21) Appl. No.: 12/484,015

(22) Filed: Jun. 12, 2009

(51) Int. Cl.
*A45C 11/00* (2006.01)

(52) U.S. Cl. ..... 206/314; 206/565; 206/477; 206/480; 206/483

(58) Field of Classification Search ..... 206/6.1, 206/314, 575, 477, 480, 483, 486, 488, 565, 206/589
See application file for complete search history.

(56) References Cited

U.S. PATENT DOCUMENTS

| | | | | |
|---|---|---|---|---|
| 1,456,613 | A * | 5/1923 | Bartels | 206/731 |
| 2,883,048 | A * | 4/1959 | Lentz | 206/562 |
| H0037 | H * | 3/1986 | Schettino | 430/497 |
| 4,993,545 | A * | 2/1991 | Feiler | 206/6.1 |
| 5,348,152 | A * | 9/1994 | Kiyoshi et al. | 206/354 |
| 6,315,121 | B1 * | 11/2001 | Hansen | 206/376 |
| 6,976,582 | B2 * | 12/2005 | Chen | 206/376 |
| 7,055,681 | B2 * | 6/2006 | Herzog | 206/6.1 |
| 7,513,361 | B1 * | 4/2009 | Mills, Jr. | 206/234 |
| 2006/0207892 | A1 * | 9/2006 | Bubenhofer et al. | 206/0.84 |

* cited by examiner

*Primary Examiner* — David T Fidei

(57) ABSTRACT

A reed case includes a base, a lid carried by the base and a reed-carrying insert provided in the base. The reed-carrying base includes a plurality of generally elongated, parallel, spaced-apart insert slots; at least one extension spring provided in each of the insert slots; and at least one retainer spring provided in each of the insert slots.

6 Claims, 6 Drawing Sheets

REED CASE

FIELD

The present disclosure relates to reed cases for storing woodwind reeds such as those for clarinet and saxophones. More particularly, the present disclosure relates to a reed case which is compact and enhances longevity of woodwind reeds carried in the reed case.

BACKGROUND

Woodwind reeds such as those for clarinets and saxophones, for example, may be carried in cases. A typical conventional reed instrument case may include a base which receives the reed and a lid which is pivotally attached to the base. The reed may be held by clips or fasteners in the base. However, conventional cases may not permit circulation of air around the reed. This may result in uneven drying and warping of the reed as it is contained in the case. Additionally, conventional reed cases may be large and bulky and difficult to carry.

SUMMARY

The present disclosure is generally directed to a reed case. An illustrative embodiment of the reed case includes a base, a lid carried by the base and a reed-carrying insert provided in the base. The reed-carrying base includes a plurality of generally elongated, parallel, spaced-apart insert slots; at least one extension spring provided in each of the insert slots; and at least one retainer spring provided in each of the insert slots.

BRIEF DESCRIPTION OF THE DRAWINGS

The disclosure will now be made, by way of example, with reference to the accompanying drawings, in which.

DETAILED DESCRIPTION

Figure 5:
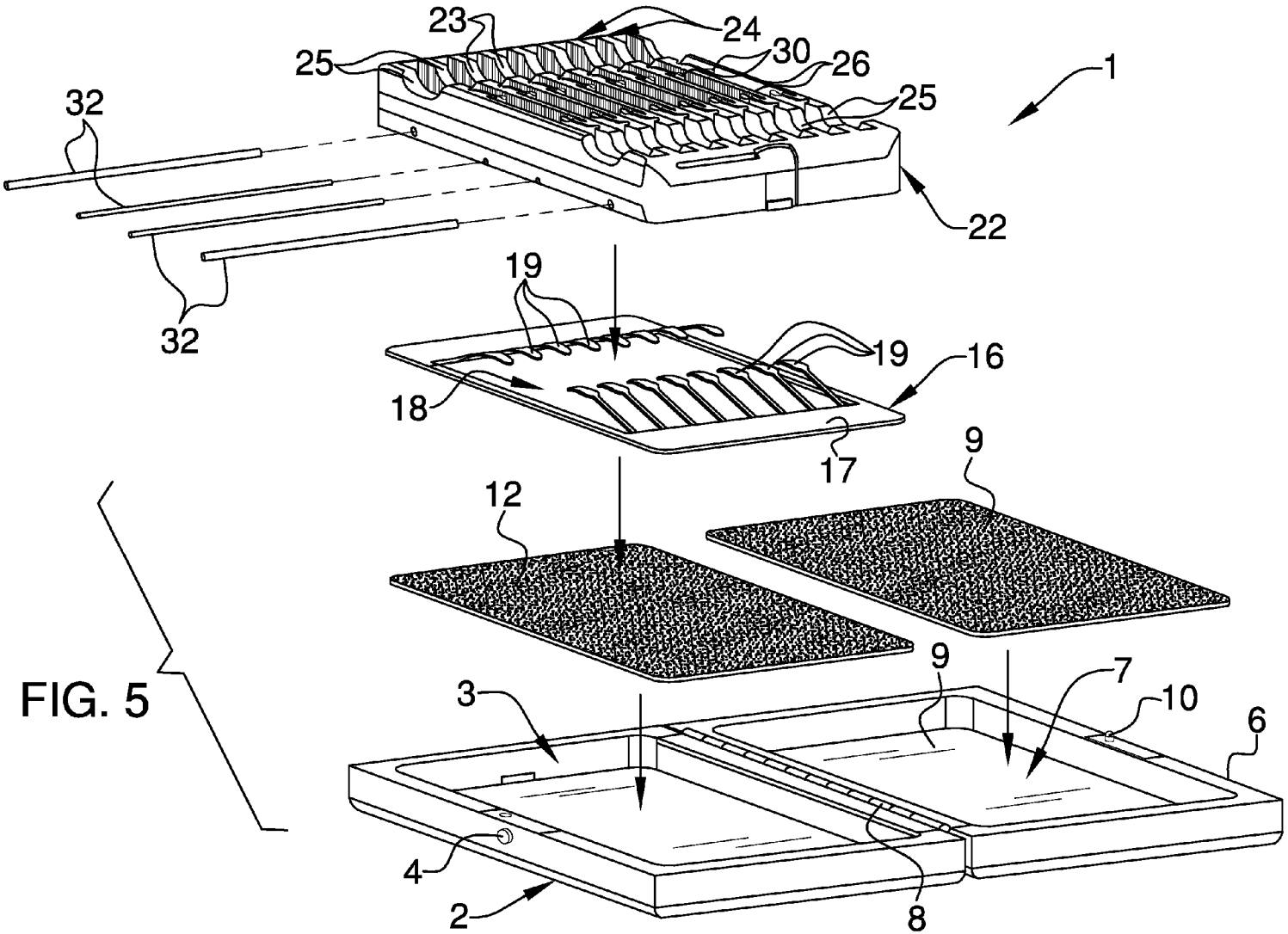
FIG. 5 is an exploded perspective view of an illustrative embodiment of the reed case.

Referring to the drawings, an illustrative embodiment of the reed case is generally indicated by reference numeral 1. The reed case 1 includes a base 2 having a base interior 3 (FIG. 5). A lid 6, which may have a lid interior 7, is pivotally attached to the base 2 by a hinge 8. In some embodiments a lid pad 9, which may be felt or other material, may be recessed in the lid interior 7 of the lid 6. A latch 10 may be provided on the lid 6 to detachably engage a latch lock 4 which is provided on the base 2 and lock the lid 6 in a closed position on the base 2.

Figure 1:
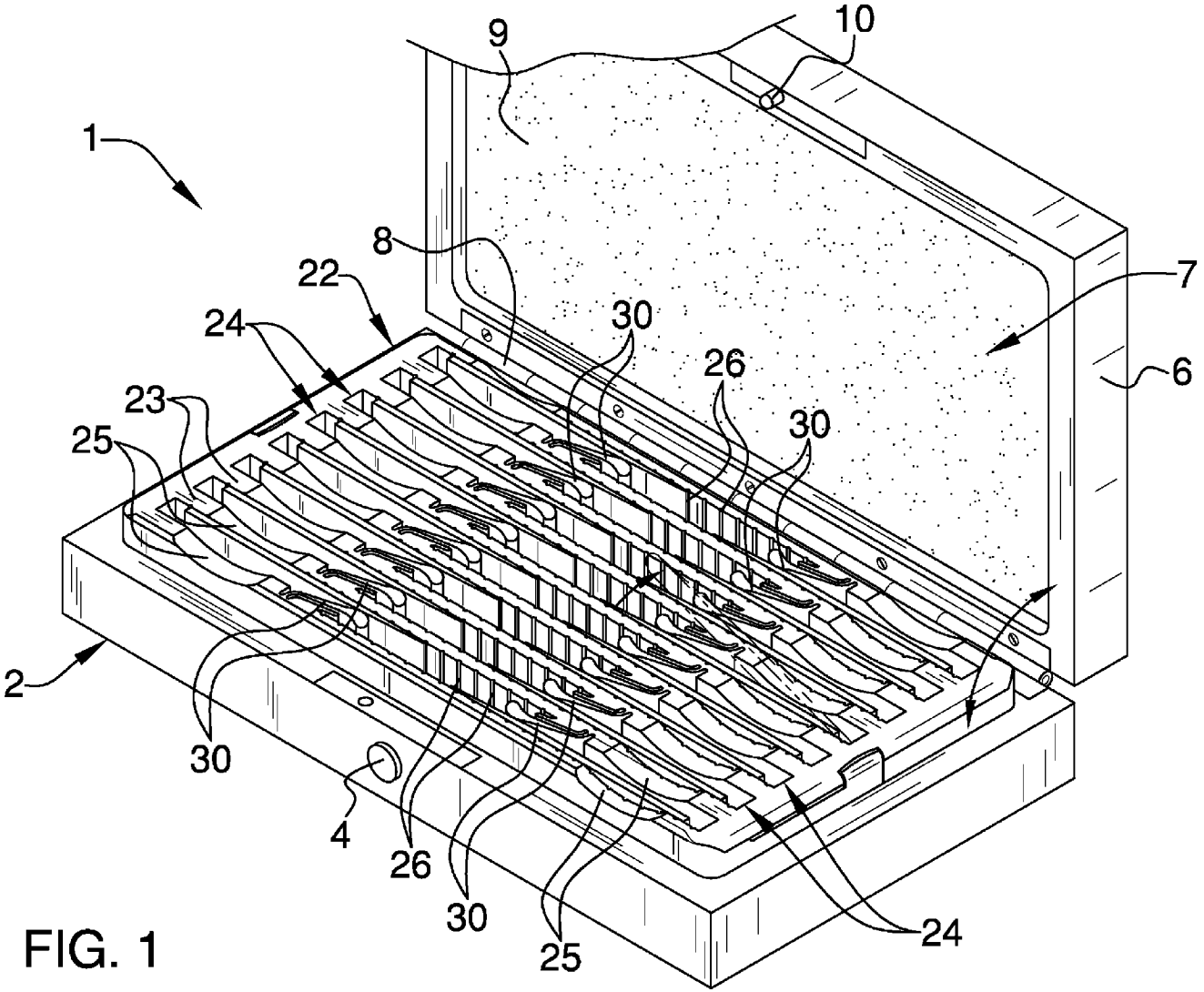
FIG. 1 is a perspective view, partially in section, of an illustrative embodiment of the reed case, shown in an open configuration.
Figure 2:
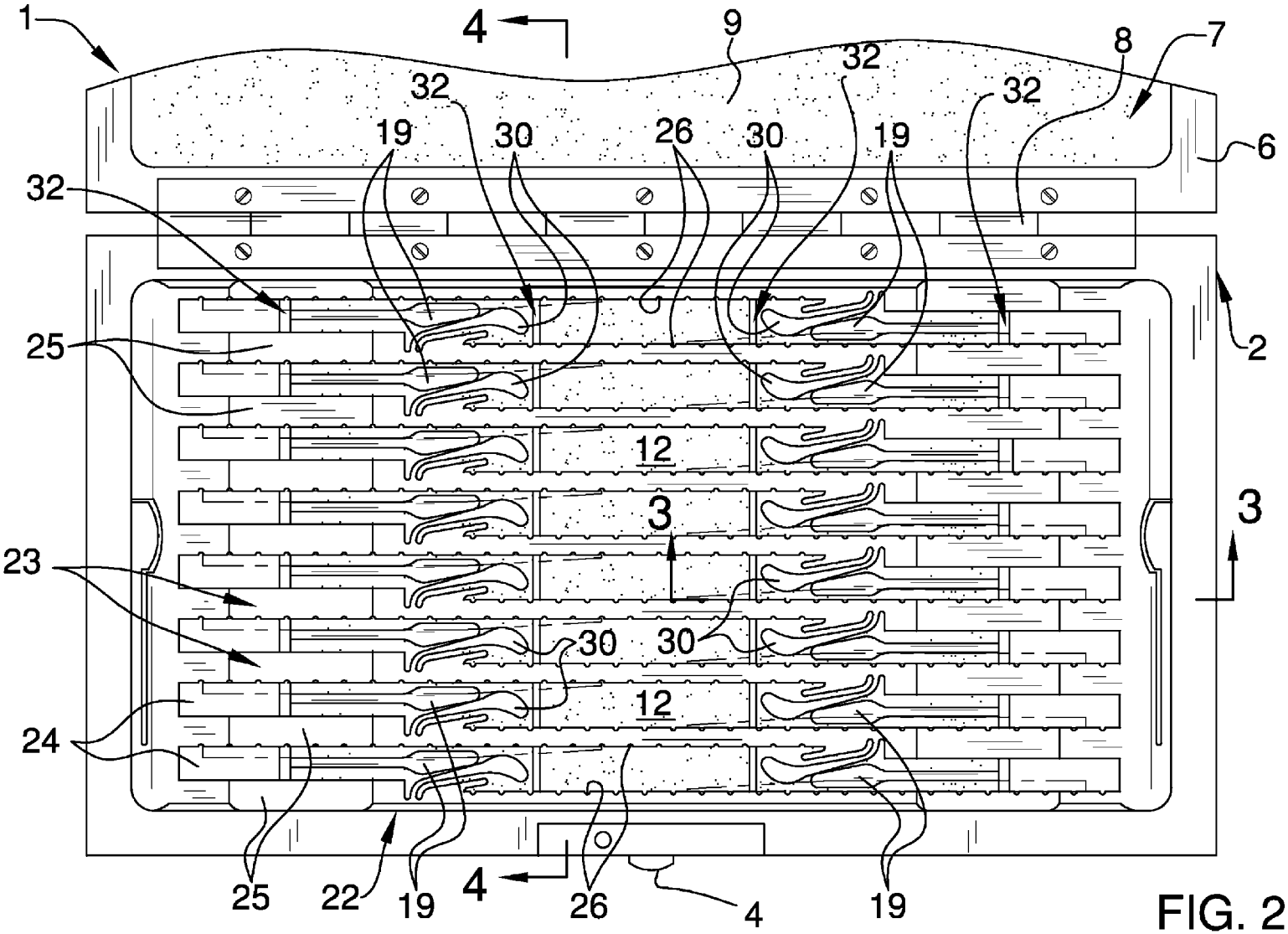
FIG. 2 is a top view of the base of an illustrative embodiment of the reed case, with a reed-carrying insert provided in the base.
Figure 3:
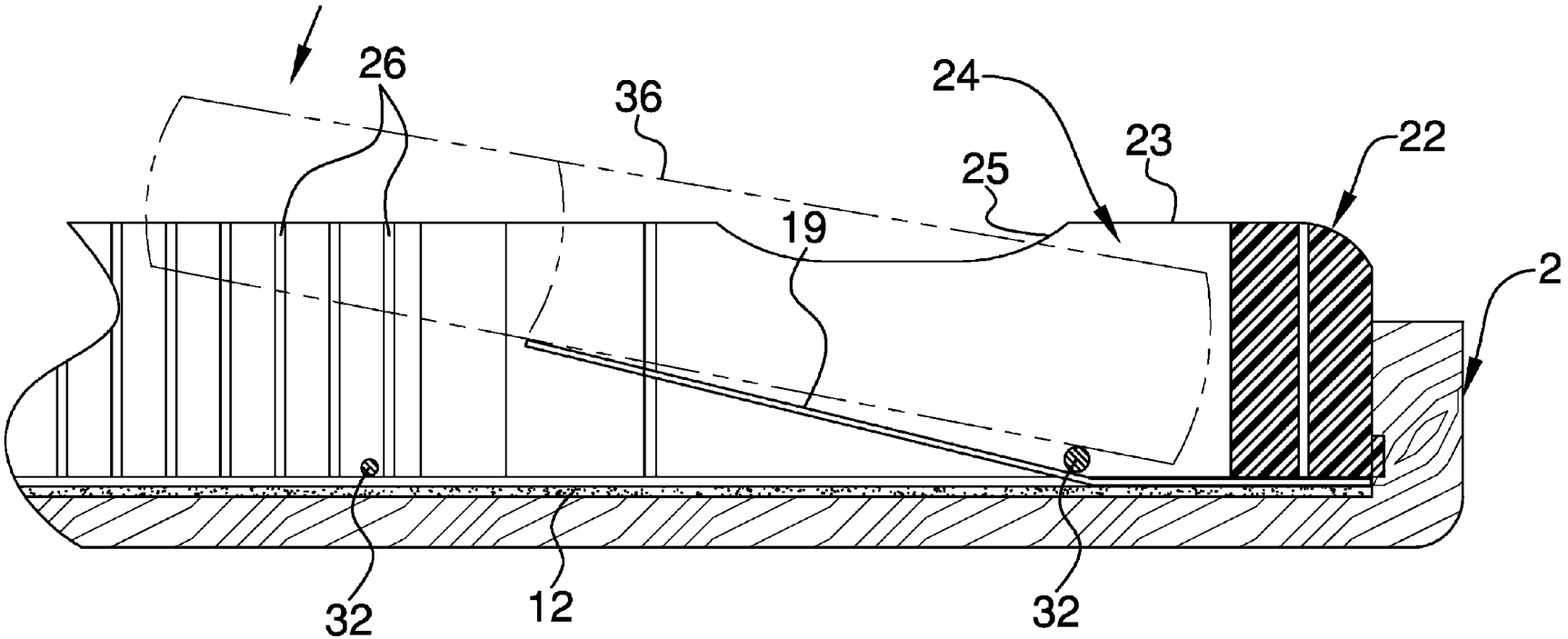
FIG. 3 is a sectional view, taken along section lines 3-3 in FIG. 2, of the reed-carrying insert and base elements of an illustrative embodiment of the reed case, more particularly illustrating placement of a reed (shown in phantom) in the reed-carrying insert.

As shown in FIG. 5, a base pad 12, which may be felt or other material, may be recessed in the base interior 3 of the base 2. As shown in FIGS. 1-3, a reed-carrying insert 22 is seated on the spring frame 17 then base pad 12 in the base interior 3. The reed-carrying insert 22 includes multiple generally elongated, parallel, spaced-apart insert walls 23. Insert slots 24 separate the adjacent insert walls 23. In some embodiments, at least one reed access groove 25 may be provided in the outer edge of each insert wall 23. In some embodiments, multiple wall notches 26 may be provided in each surface of each insert wall 23 along both sides of each insert slot 24. A flexible retainer spring 30 may extend from one surface of each insert wall 23 into the adjacent insert slot 24. As shown in FIG. 3, a flexible extension spring 19 may extend into each insert slot 24 beneath or inwardly of the retainer spring 30.

Figure 6:
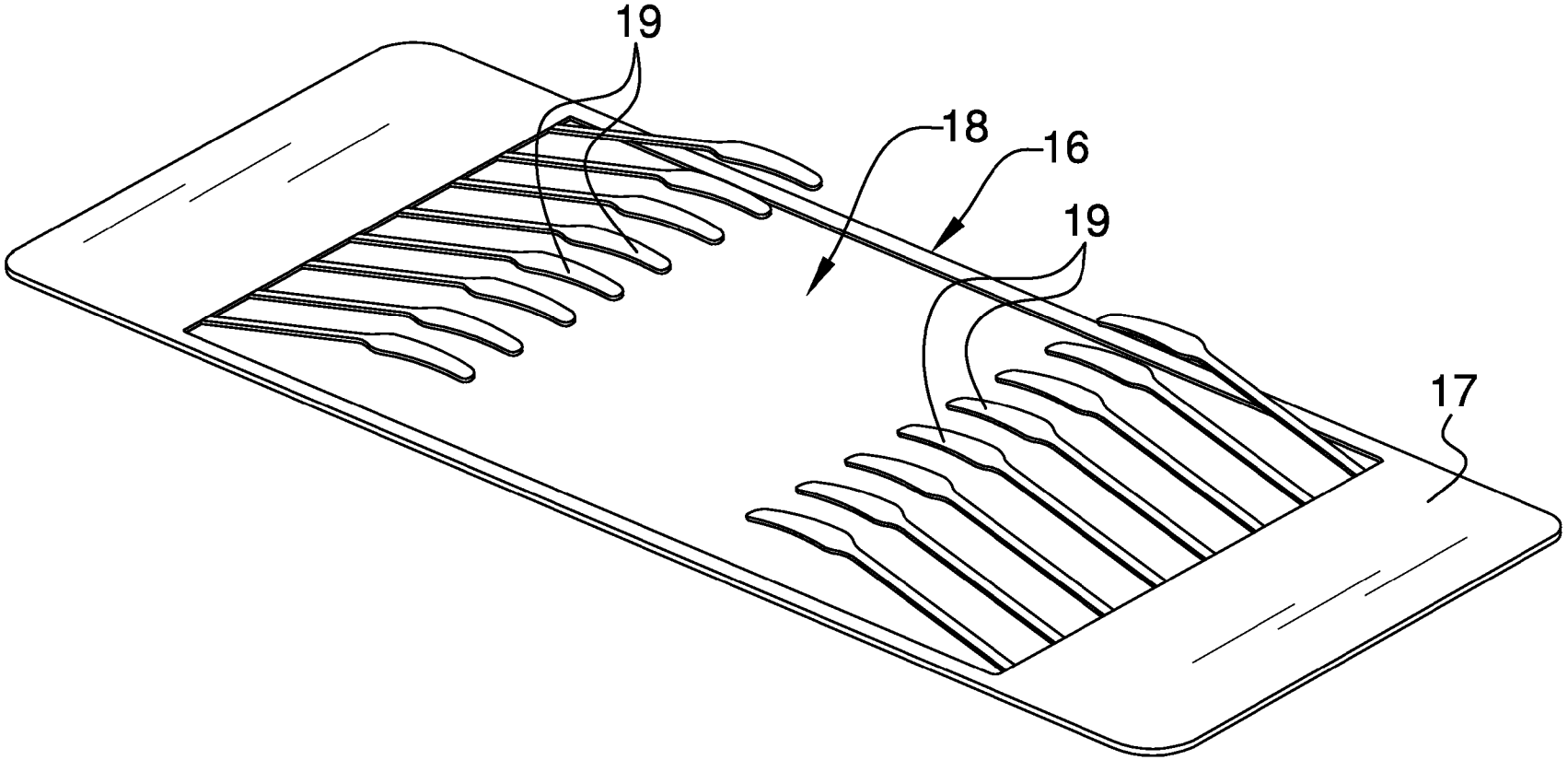
FIG. 6 is a perspective view of a extension spring assembly of an illustrative embodiment of the reed case.

As shown in FIGS. 5 and 6, in some embodiments the extension springs 19 may be part of an extension spring assembly 16 which is seated in the base interior 3 of the base 2 between the base pad 12 and the reed-carrying insert 22. The extension spring assembly 16 may include an assembly frame 17 having an assembly frame opening 18. The extension springs 19 may extend generally upwardly and inwardly from respective sides of the assembly frame 17, over the assembly frame opening 18. Accordingly, as shown in FIG. 2, a pair of extension springs 19 extends into each insert slot 24 of the reed-carrying insert 22 when the reed-carrying insert 22 is seated in the base interior 3 of the base 2. Two tabs on the end of the insert 22 are flexible springs. When the insert 22 is inserted into the base interior 3, the tabs lock the insert 22 into place, as shown in FIG. 3.

Figure 4:
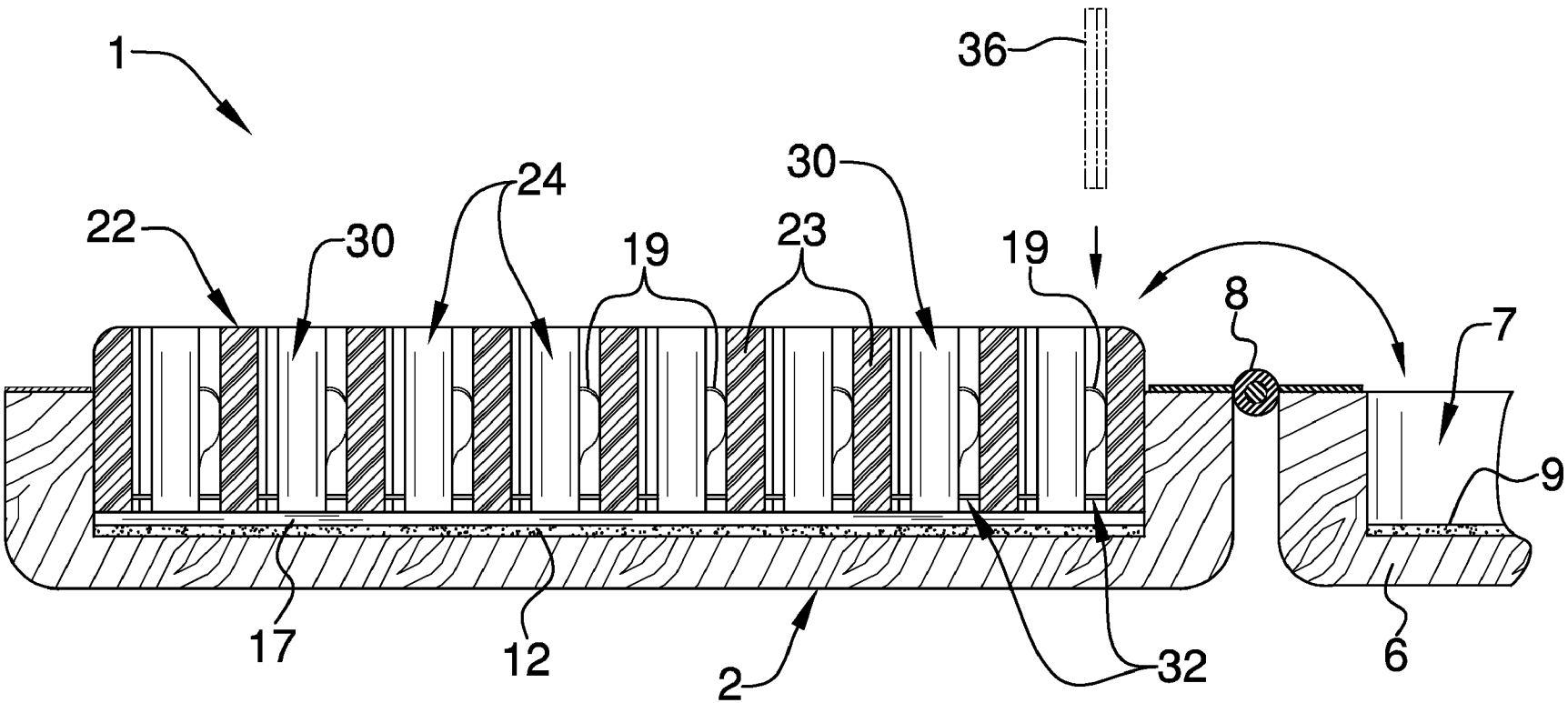
FIG. 4 is a sectional view, taken along section lines 4-4 in FIG. 2, of the reed-carrying insert and base, more particularly illustrating placement of a reed (shown in phantom) in the reed-carrying insert.

As shown in FIGS. 3 and 4, in typical use of the reed case 1, the latch lock 4 is unlocked and the latch 10 removed from the latch lock 4 as the lid 6 is pivoted open on the base 2. A reed or reeds 36 (shown in phantom) is/are then inserted in one or more of the insert slots 24 of the reed-carrying insert 22, and slid towards the center of the case (aided by the rolling pins 32). Accordingly, the retainer spring 30 holds the reed in place with friction. The lid 6 may then be closed on the base 2 and the latch 10 on the lid 6 locked in the latch lock 4 of the base 2. It will be appreciated by those skilled in the art that the wall notches 26 in the respective sides of each insert slot 24 facilitates circulation of air around the reed 36 as the reed 36 is carried in reed case 1. This circulation of air around the reed 36 may facilitate uniform drying and prevent warping of the reed 36 under circumstances in which the reed 36 is wet or damp when placed in reed case 1. Moreover, the compact design of the reed case 1 facilitates easy carrying of one or multiple reeds 36 in the reed case 1, as desired.

When removal of the reed 36 from the reed case 1 is desired, the latch lock 4 is unlocked and the latch 10 removed from the latch lock 4 as the lid 6 is pivoted open on the base 2. The reed 36 is slid toward the outer end of the case (with the aid of the rolling pins 32). The reed is thus released from the retainer spring 30 and the extension spring 19 will push the reed 36 out from slot 24. The lid 6 may then be closed on the base 2 and the latch 10 on the lid 6 locked in the latch lock 4 of the base 2.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A reed case, comprising:

a base having a base interior;

a lid pivotally carried by said base; and a reed-carrying insert seated in said base interior of said base and comprising:

a plurality of generally elongated, parallel, spaced-apart insert walls;

a plurality of generally elongated, parallel, spaced-apart insert slots defined between said insert walls;

an extension spring assembly comprising:

an assembly frame having an assembly frame opening seated between said reed-carrying insert and said base; and a plurality of extension springs extending from said assembly frame over said frame opening and into said plurality of insert slots, respectively, of said reed-carrying insert; and at least one retainer spring provided in each of said plurality of insert slots.

2. The reed case of claim 1 further comprising a base pad provided in said base.

3. The reed case of claim 1 further comprising a lid pad provided in said lid.

4. The reed case of claim 1 further comprising a plurality of wall notches provided in each of said insert walls in said insert slots.

5. The reed case of claim 1 further comprising at least one reed access groove provided in each of said plurality of insert walls.

6. The reed case of claim 1 further comprising a latch carried by said lid and a latch lock provided on said base and detachably engaging said latch.

* * * * *